US005287986A

United States Patent [19]

Frost

[11] Patent Number: 5,287,986

[45] Date of Patent: Feb. 22, 1994

[54] CONTAINMENT TANK ASSEMBLY

[75] Inventor: James O. Frost, Swartz, La.

[73] Assignee: Abell Corporation, Monroe, La.

[21] Appl. No.: 16,299

[22] Filed: Feb. 11, 1993

[51] Int. Cl.[5] ..... B65D 88/76

[52] U.S. Cl. ..... 220/565; 220/4.13; 220/410; 220/446; 220/447; 220/469; 220/675

[58] Field of Search ..... 220/4.13, 408, 410, 220/425, 428, 431, 447, 465, 565, 626, 446, 4.12, 469, 601, 675

[56] References Cited

U.S. PATENT DOCUMENTS

| | | | |
|---|---|---|---|
| 665,349 | 1/1901 | Sewall . | |
| 963,454 | 7/1910 | Meinecke | 220/410 X |
| 1,330,868 | 2/1920 | Harrison | 220/408 X |
| 1,551,007 | 8/1925 | Bruns | 220/469 |
| 1,618,675 | 2/1927 | Quigley | 220/408 |
| 1,983,118 | 12/1934 | Bourque | 220/408 |
| 2,043,045 | 6/1936 | Krinard | 220/410 |
| 2,637,459 | 5/1953 | Jordan | 220/408 X |
| 3,304,852 | 2/1967 | Lande . | |
| 3,760,972 | 9/1973 | McKirnan | 220/410 |
| 4,513,550 | 4/1985 | Kotcharian . | |
| 4,651,894 | 3/1987 | Ebert | 220/469 |
| 4,871,081 | 10/1989 | Ershig | 220/469 X |
| 5,165,569 | 11/1992 | Furuhashi et al. | 220/466 |
| 5,201,432 | 4/1993 | Elvin-Jensen | 220/1.5 |

*Primary Examiner*—Allan N. Shoap
*Assistant Examiner*—Stephen K. Cronin
*Attorney, Agent, or Firm*—Brady, O'Boyle & Gates

[57] ABSTRACT

A containment tank assembly for the safe storage of liquids wherein an enclosed storage tank is positioned within an open-top containment tank. A space is provided between the adjacent side walls of the storage and containment tanks for receiving any leakage from the storage tank, and a roof extends over the space between the side walls to prevent the leaked liquid in the space from becoming contaminated with rain water.

7 Claims, 3 Drawing Sheets

FIG. 1
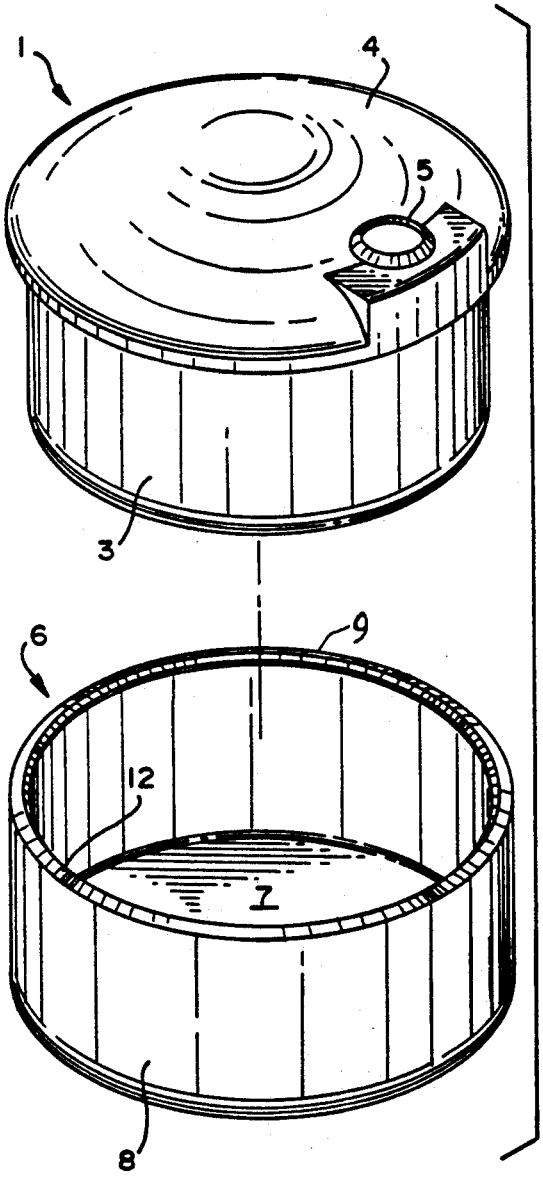
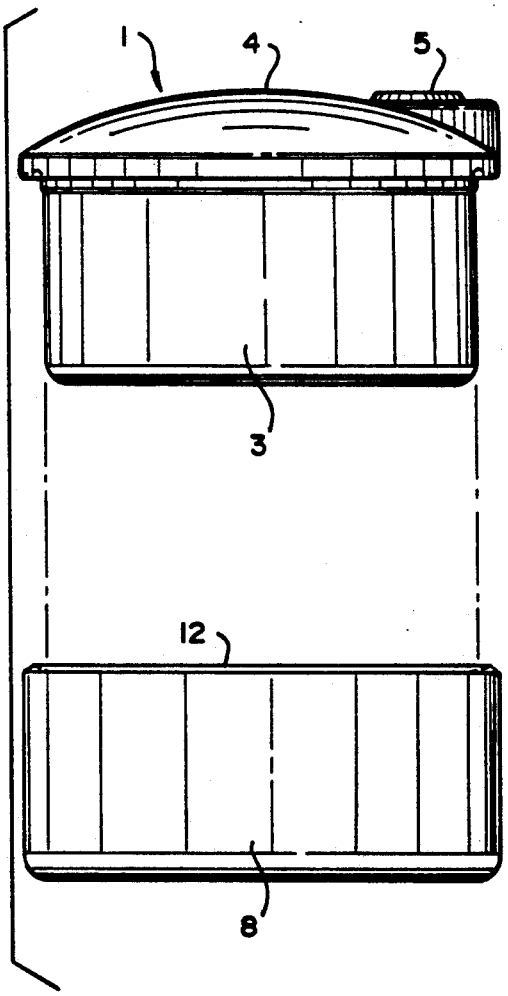
FIG. 2

CONTAINMENT TANK ASSEMBLY

BACKGROUND OF THE INVENTION

In the storage of various liquids, such as gasoline, oil, fertilizer, hazardous chemicals and the like, tank farms have to be constantly vigilant about the tanks leaking liquid into the ground, thereby polluting the environment when the spilled liquid is leached through the supporting soil.

SUMMARY OF THE INVENTION

In order to prevent the leakage of liquids from storage tanks, the containment assembly of the present invention has been devised which comprises, essentially, a pair of molded plastic tanks, fit one into the other. The outer tank is open at the top, and the inner tank fits within the outer tank with a clearance between the adjacent side walls. The inner tank is closed at the top with an integral domed-shaped closure supporting the conventional manway and suitable pipe and valve assembly for filling and emptying the tank. The domed-shaped closure is formed with an inwardly extending peripheral lip which cooperates with an inwardly extending peripheral lip integral with the top edge of the outer tank. The peripheral lips extend over the space between the tank walls to prevent rainwater from entering therein.

By this construction and arrangement, if a leak should occur in the inner tank, the liquid flows into the space between the inner and outer tanks and is contained therein, thereby preventing the leakage of the liquid into the environment.

BRIEF DESCRIPTION OF THE DRAWINGS

FIG. 1 is a perspective exploded view of the containment tank assembly of the present invention showing the inner storage tank, and the outer containment tank:

FIG. 2 is a side elevational view of the tanks shown in FIG. 1;

DESCRIPTION OF THE PREFERRED EMBODIMENTS

Figure 3:
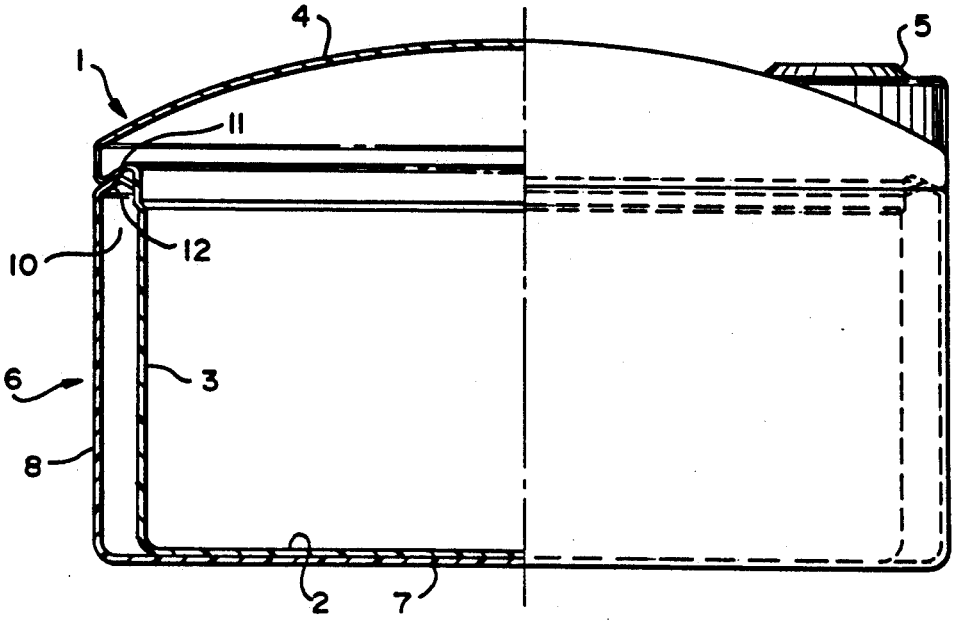
FIG. 3 is a side elevational view, partly in section, showing the inner storage tank positioned within the containment tank.

Referring to the drawings and more particularly to FIGS. 1 to 3, the containment tank assembly of the present invention comprises, a primary storage tank 1 having a bottom wall 2, a side wall 3 and an integral domed-shaped closure 4 having a conventional manway 5 and suitable pipe and valve assembly, not shown, for filling and emptying the storage tank.

A secondary containment tank 6 is provided for receiving the storage tank 1 and comprises a bottom wall 7, a side wall 8 and an open top 9.

The diameter of the storage tank 1 is less than the diameter of the containment tank 6 so that, when the storage tank 1 is fit within the containment tank 6, as shown in FIG. 3, the bottom wall 3 of the storage tanks rests on the bottom wall of the containment tank 7 and there is a clearance forming a space 10 between the adjacent side walls 3 and 8 of the respective tanks.

Figure 4:
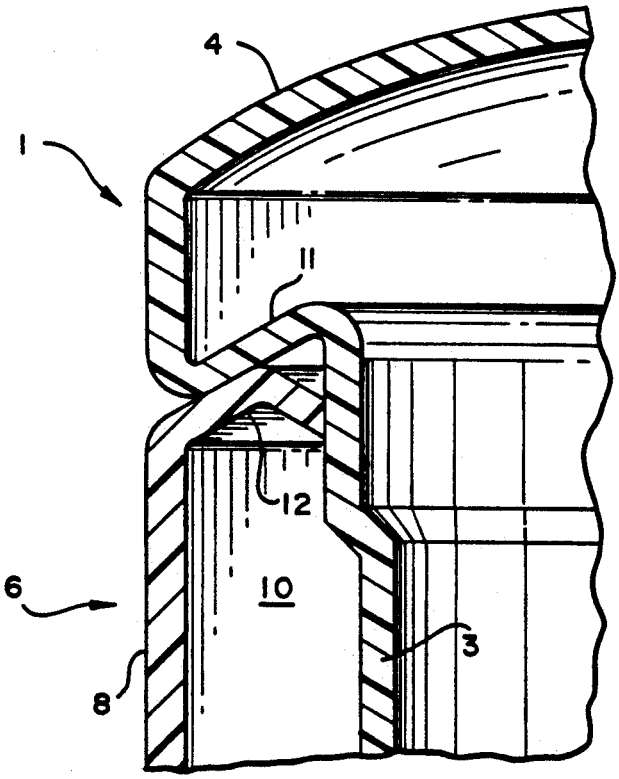
FIG. 4 is an enlarged, fragmentary sectional view showing the cooperating peripheral lips between the domed-shaped closure on the storage tank, and the containment tank.

As will be seen in FIG. 4, the domed closure 4 is formed with an inwardly extending peripheral lip 11 which cooperates with an inwardly extending peripheral lip 12 integral with the top edge of the containment tank 6. The cooperating lips 11 and 12 extend over the space 10 between the tank walls 3 and 8 to prevent rain water from entering therein.

Figure 5:
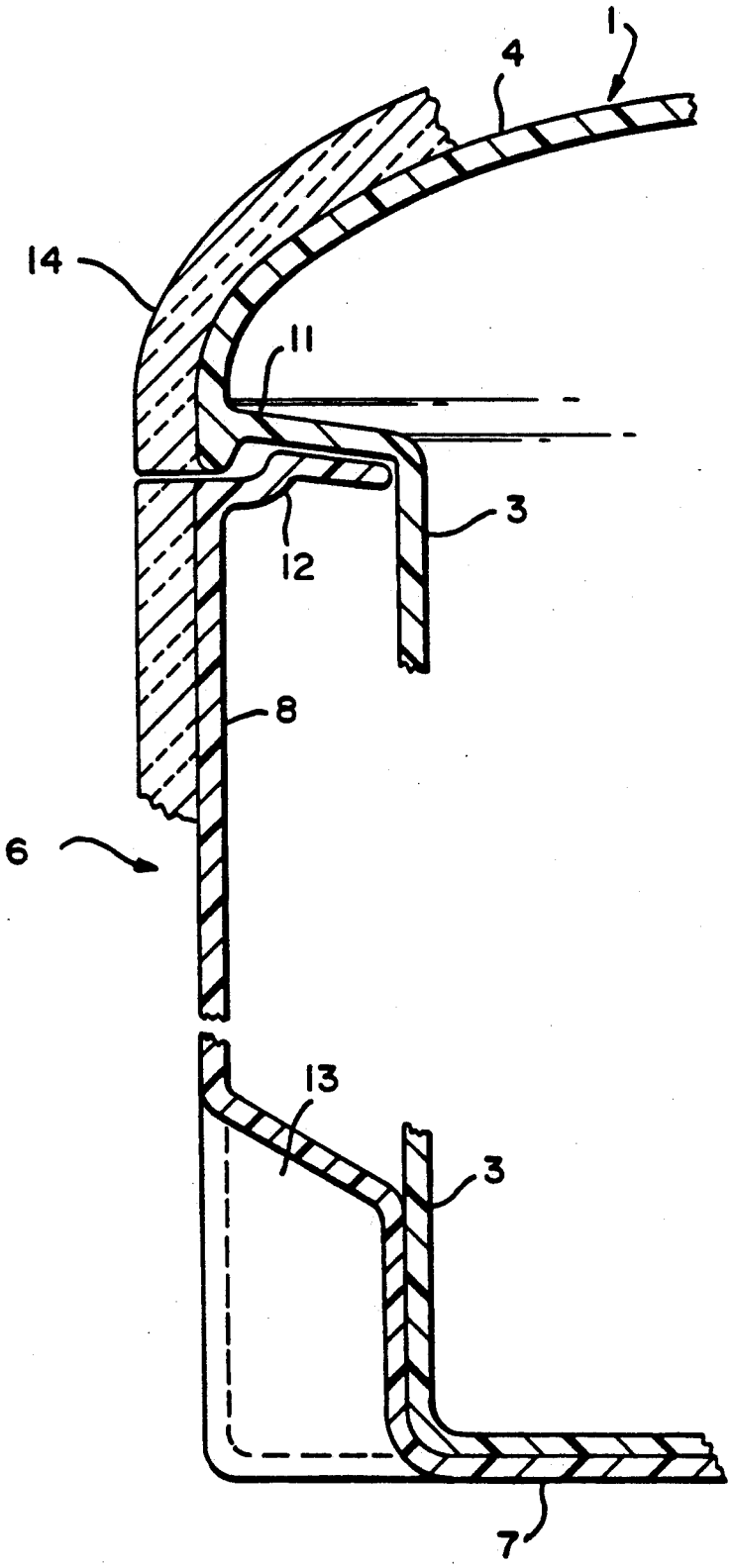
FIG. 5 is an enlarged fragmentary sectional view of another embodiment of the containment tank assembly of the present invention.

FIG. 5 illustrates another embodiment of the containment tank assembly of the present invention wherein the lower portion of the side wall 8 of the containment tank 6 adjacent the bottom wall 7 thereof is provided with a plurality of circumferentially spaced inwardly extending embossments 13 which function as restraints to reinforce the lower portion of the side wall 3 of the storage tank 1.

While the closure lip 11 shown in FIG. 4 slopes downwardly in a direction outwardly from the storage tank 1, the lip 11 shown in FIG. 5 slopes downwardly in a direction inwardly to the storage tank so that condensed liquid vapors can collect thereon and flow back into the storage tank 3, and while the cooperating peripheral lips 11 and 12, as shown in FIG. 4, are in abutting relationship, they can also be spaced from each other as shown in FIG. 5, and if desired a layer of insulation 14 can be applied to the outer surface of the containment tank assembly.

The storage tank 1 and containment tank 6 are of molded plastic construction but other types of material, such as metal or concrete, could also be employed. Also, the tanks may be cylindrical.

From the above description, it will be appreciated by those skilled in the art that the containment tank assembly of the present invention provides a safe storage against leakage from a storage tank since any leakage from the storage tank 1 will flow into the space 10 and while there will be protected from becoming contaminated by rain water by the construction and arrangement of the peripheral lips 11 and 12 extending over the space 10.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A containment tank assembly for storing fluid material comprising, a primary storage tank having a bottom wall, a side wall integral with the bottom wall and a closure integral with the top edge of the side wall, a secondary containment tank having a bottom wall and a side wall integral with the bottom wall, said secondary containment tank being open at the top, said primary storage tank being positioned within said secondary containment tank with the bottom wall of the primary storage tank being seated on the bottom wall of the secondary containment tank, the side wall width of said primary storage tank being less than the side wall width of said secondary containment tank to thereby provide a space between the adjacent side walls of the respective tanks, said space receiving any leakage of fluid from the primary storage tank, and a roof over said space to prevent any leakage therein from becoming contaminated by rain water, said roof comprising, a first lip integral with a perimeter of the closure in proximity to the top edge of the secondary containment tank, said first lip extending inwardly to the sidewall of said primary storage tank over said space, and a second lip integral with the top edge of the secondary containment tank, said second lip being positioned under said first lip and extending inwardly over said space.

2. A containment tank assembly according to claim 1, wherein the second lip is sloped downwardly, whereby condensed liquid vapors collect thereon and flow back into the storage tank.

3. A containment tank assembly according to claim 1, wherein the first and second lips are in abutting relationship.

4. A containment tank assembly according to claim 1, wherein the first and second lips are in spaced relationship.

5. A containment tank assembly according to claim 1, wherein a plurality of peripherally spaced, inwardly extending embossments are provided in the lower portion of the side wall of the containment tank to thereby reinforce the lower portion of the side wall of the storage tank.

6. A containment tank assembly according to claim 1, wherein the closure has a configuration of a dome and a manway is provided in the closure.

7. A containment tank assembly according to claim 1, wherein the storage tank and containment tank are of molded plastic construction.

* * * * *